US007317372B2

(12) United States Patent
Yoshimori

(10) Patent No.: US 7,317,372 B2
(45) Date of Patent: Jan. 8, 2008

(54) AIR-CORE COIL AND PROCESS FOR FABRICATING THE SAME

(75) Inventor: Hitoshi Yoshimori, Nara (JP)

(73) Assignee: SHT Corporation Limited, Osaka-shi (JP)

( * ) Notice: Subject to any disclaimer, the term of this patent is extended or adjusted under 35 U.S.C. 154(b) by 0 days.

(21) Appl. No.: 10/516,302

(22) PCT Filed: Dec. 9, 2002

(86) PCT No.: PCT/JP02/12877

§ 371 (c)(1),
(2), (4) Date: Dec. 9, 2004

(87) PCT Pub. No.: WO03/105165

PCT Pub. Date: Dec. 18, 2003

(65) Prior Publication Data

US 2005/0212644 A1 Sep. 29, 2005

(30) Foreign Application Priority Data

Jun. 11, 2002 (JP) ..... 2002-169785

(51) Int. Cl.
*H01F 27/28* (2006.01)

(52) U.S. Cl. ..... 336/189; 336/190; 336/222

(58) Field of Classification Search ..... 336/189, 336/199, 200, 223, 130–135
See application file for complete search history.

(56) References Cited

U.S. PATENT DOCUMENTS 3,160,838 A * 12/1964 Fahrettin ..... 336/69
3,705,371 A * 12/1972 Van Nice ..... 336/70
3,983,522 A * 9/1976 Gearhart ..... 336/70

FOREIGN PATENT DOCUMENTS

| | | | |
|---|---|---|---|
| JP | 55-138823 | | 10/1980 |
| JP | 58148414 | A * | 9/1983 |
| JP | 04364011 | A * | 12/1992 |
| JP | 2000-277337 | | 10/2000 |

* cited by examiner

*Primary Examiner*—Anh Mai
(74) *Attorney, Agent, or Firm*—Kratz, Quintos & Hanson, LLP

(57) ABSTRACT

The present invention provides an air-core coil 21 wherein one conductor is wound into a spiral form to thereby form consecutively, axially of the coil, a plurality of unit turn portions (25, 26, 27) which are different from each other in inner peripheral length and to form, axially of the coil, unit coil portions comprising the plurality of unit turn portions (25, 26, 27) to produce a partly finished coil 20, and thereafter the partly finished coil 20 is compressed to force the unit turn portion of small inner peripheral length inwardly of the unit turn portion of great inner peripheral length from among the unit turn portions providing each of the unit coil portions to thereby make each of the unit coil portions multi-layered. Thus the air-core coil 21 exhibits a smaller voltage across layers than conventionally and excellent frequency characteristics.

5 Claims, 11 Drawing Sheets

AIR-CORE COIL AND PROCESS FOR FABRICATING THE SAME

BACKGROUND OF THE INVENTION

1. Field of the Invention

The present invention relates to coils to be provided in rectifier circuits, noise eliminating circuits, resonance circuits, etc. for use in various AC devices, and a process for fabricating the coils.

2. Description of the Related Art

Conventionally known is a coil device of the toroidal type, which comprises an air-core coil 81 fitted around a bobbin 10, as shown in FIG. 11. The air-core coil 81 is fabricated, for example, by winding a conductor around an outer surface of a wire winding jig (not shown) in the order indicated by the numerals of 1 to 29 as shown in the drawing. First the conductor is wound around the outer surface of the jig in the order of 1 to 10 to form a first layer 82, thereafter the conductor is wound around the outer surface of the first layer 82 in the order of 11 to 19 to form a second layer 83, and finally the conductor is wound around the outer surface of the second layer 83 in the order of 20 to 29 to form a third layer 84, to thereby fabricate the air-core coil 81 having three layers.

With the air-core coil 81 shown in FIG. 11, however, the first layer 82, the second layer 83 and the third layer 84 are lapped over as connected to each other in series. This results in the appearance of a stray capacity between each pair of turns of the conductor adjacent to each other axially of the coil and the appearance of a stray capacity between each pair of turns of the conductor lapped over in a direction orthogonal to an axis of the coil, as shown in FIG. 12. In this case the number 1 turn in the first layer 82 and the number 19 turn in the second layer 83 are lapped over each other, and the number 11 turn in the second layer 83 and the number 29 turn in the third layer 84 are lapped over each other, thus rendering high a potential difference between the turns lapped over each other, i.e., voltage across the layers, as shown in FIG. 12. This gives rise to the problem of the voltage resistance of the air-core coil 81. Furthermore there is also the problem of impaired frequency characteristics of the air-core coil 81 due to the increased stray capacity.

The present applicant has proposed the process shown in FIGS. 13(*a*) and 13(*b*) for fabricating a coil device which comprises a coil fitted around a core (see the publication of JP-A No. 2000-277337). According to this fabrication process, a coil device as shown in FIG. 13(*b*) is fabricated by inserting one side portion of an air-core coil 8 into a center hole 70 of a C-shaped core 7 through a gap portion 71 thereof as shown in FIG. 13(*a*) and fitting the coil 8 around the core 7. With this fabrication process, the air-core coil 8 separated from the core 7 is made, and the coil 8 is thereafter fitted around the core 7 to complete the coil device. The process is therefore simplified by eliminating the need to wind a wire around the core 7 and making the air-core coil 8 automatically.

In fabricating the conventional coil device shown in FIGS. 13(*a*) and 13(*b*), a rectangular conductor or trapezoidal conductor can be used as the conductor of the air-core coil in order to increase the ratio of the sectional area of the turns of conductor 9 passing through the center hole 70 of the core 7, to the total area of the center hole 70, i.e., the space factor of the conductor 9. When having the same cross sectional area as a round conductor, the rectangular conductor and trapezoidal conductor have a short side which is smaller than the diameter of the round conductor, so that an increased number of turns of conductor can then be accommodated in the center hole 70 of the core 7, hence a higher space factor. However, the rectangular or trapezoidal conductor has the problem of being more expensive than the round conductor.

Another process for fabricating a coil device of higher space factor is known which comprises winding a conductor 9 around a core 7 in the order indicated by the numerals of 1 to 13 in FIG. 14(*a*), and thereafter winding the conductor 9 around the core 7 in the order indicated by the numerals of 14 to 23 in FIG. 14(*b*) so as to provide one coil layer on the outer peripheral side of the core 7 and two coil layers on the inner peripheral side of the core 7. An increased number of turns of conductor can then be accommodated in the center hole 70 of the core 7 to result in a higher space factor. The conductor 9 is nevertheless difficult to wind around the core 7 automatically and must be wound by manual work, which involves the problem of low production efficiency.

Accordingly, an object of the present invention is to provide an air-core coil which has a lower voltage across the layers than conventionally and improved frequency characteristics and which can achieve a high space factor without using a rectangular or trapezoidal conductor, and a process for fabricating the air-core coil which process can be practiced automatically.

SUMMARY OF THE INVENTION

The present invention provides an air-core coil comprising unit coil portions each having at least one conductor wound into a spiral form, the unit coil portions being arranged repeatedly axially of the coil, each of the unit coil portions comprising a plurality of unit turn portions which are different from each other in inner peripheral length, the unit turn portion of small inner peripheral length being at least partly forced inwardly of the unit turn portion of great inner peripheral length.

Stated specifically, the plurality of unit turn portions providing each of the unit coil portions are sequentially wound from an inner peripheral side to an outer peripheral side, or from the outer peripheral side to the inner peripheral side. One unit turn portion on an outermost periphery or on an innermost periphery is connected to another unit turn portion on an outermost periphery or on an innermost periphery of the adjacent unit coil portion.

With the air-core coil of the present invention, the plurality of unit turn portions providing each of the unit coil portions are lapped over in a direction intersecting the axis of the coil. These unit turn portions are sequentially formed by winding one continuous conductor. The winding numbers are consecutive, so that a stray capacity between turns is small. Furthermore, with each pair of unit coil portions adjacent to each other, a plurality of unit turn portions are lapped over axially of the coil. Each pair of the unit coil potions adjacent to each other is sequentially formed by the one continuous conductor, to render relatively small the stray capacity between turns.

According to a process for fabricating the air-core coil of the present invention, a plurality of unit turn portions which are different from each other in inner peripheral length are consecutively formed axially of the coil, and the unit coil portions comprising the unit turn portions are repeatedly formed axially of the coil, by winding at least one conductor into a spiral form, to produce a partly finished air-core coil, and the unit turn portions of small inner peripheral length are thereafter at least partly forced inwardly of the unit turn portions of great inner peripheral length from among the unit turn portions providing each of the unit coils by compressing the partly finished coil axially of the coil, whereby each of the unit coil portions is made at least partly multi-layered.

According to the fabrication process, the partly finished air-core coil can be fabricated with ease by winding one conductor into a spiral form while varying the inner peripheral length, because with the partly finished air-core coil having arranged axially of the coil a plurality of unit turn portions which are different in inner peripheral length, the conductor forming the unit turn portions is not lapped over in a direction orthogonal to an axis of the coil (in a direction of winding diameter). The partly finished air-core coil thus obtained is merely compressed axially of the coil to thereby obtain the air-core coil of the present invention described.

Stated specifically, the partly finished coil is fabricated by winding the conductor around an outer peripheral surface of a wire wiring jig. The wire wiring jig comprises a plurality of winding cores arranged axially of the coil. Each pair of the winding cores adjacent to each other differs in outer peripheral length. The unit turn portion of small inner peripheral length is formed by winding the conductor around the wiring core of small outer peripheral length of the jig. The unit turn portion of great inner peripheral length is formed by winding the conductor around the wiring core of great outer peripheral length of the jig.

According to the specific construction, the partly finished coil comprising a plurality of turn portions of varied inner peripheral lengths can be fabricated with ease by winding the conductor around the jig. Accordingly the fabrication process can be automated.

As described above, the air-core coil of the present invention exhibits a smaller stray capacity between the turns of the conductor than conventionally, resulting in reduced voltage between the layers, to obtain an excellent voltage resistance and improved frequency characteristics. Furthermore, the coil device including the air-core coil of the present invention can achieve high space factor irrespective of the type of conductor used. The air-core coil fabricating process of the present invention can be practiced automatically.

BRIEF DESCRIPTION OF THE DRAWINGS

FIG. 6(*b*) is a side elevation of the stepped member;

FIG. 7(*b*) is a sectional view of the partly finished coil;

FIG. 8(*b*) is a sectional view of the partly finished coil as viewed from a direction different from FIG. 7(*b*);

BEST MODE FOR CARRYING OUT THE INVENTION

An embodiment of the present invention will be described below in detail with reference to the drawings.

Figure 1:
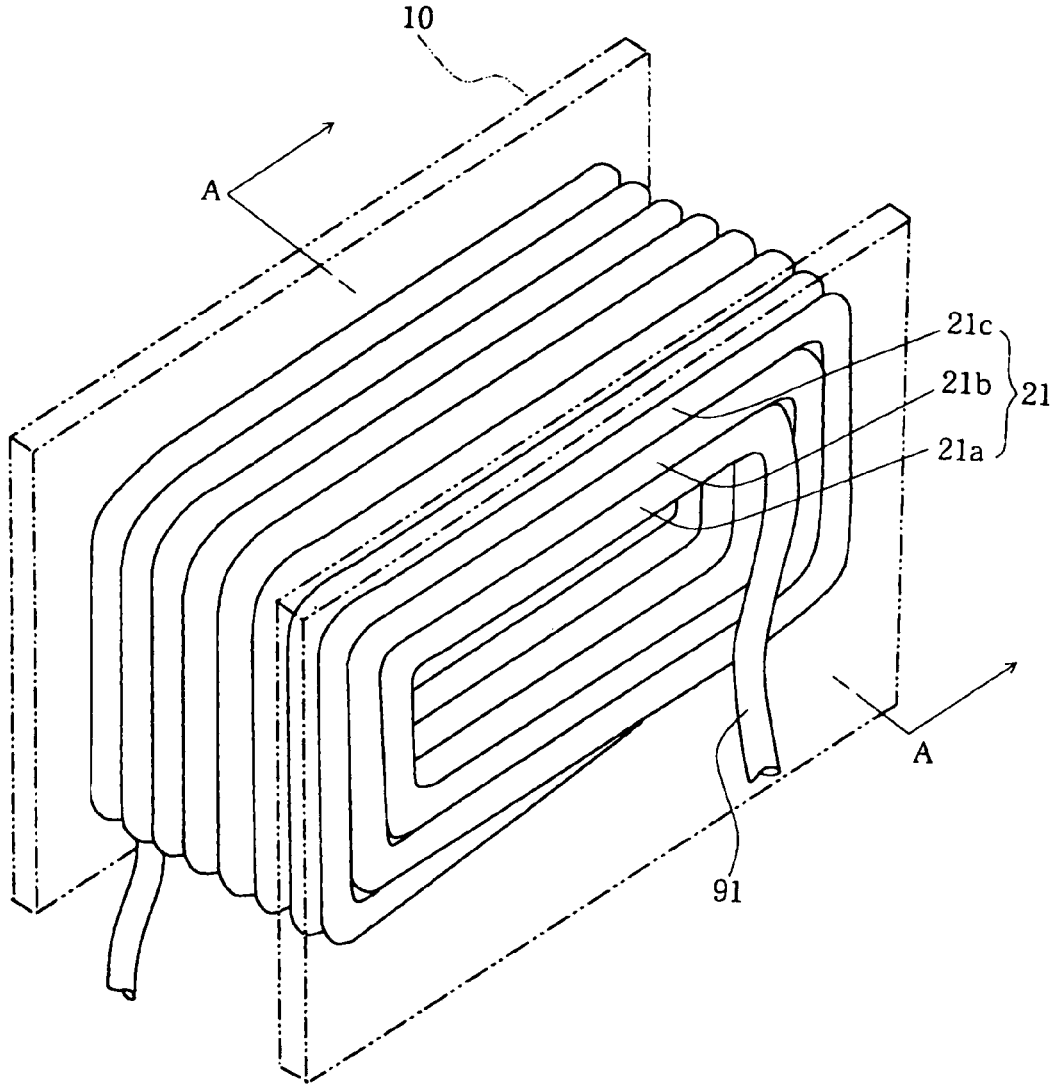
FIG. 1 is a perspective view of an air-core coil embodying the present invention.
Figure 2:
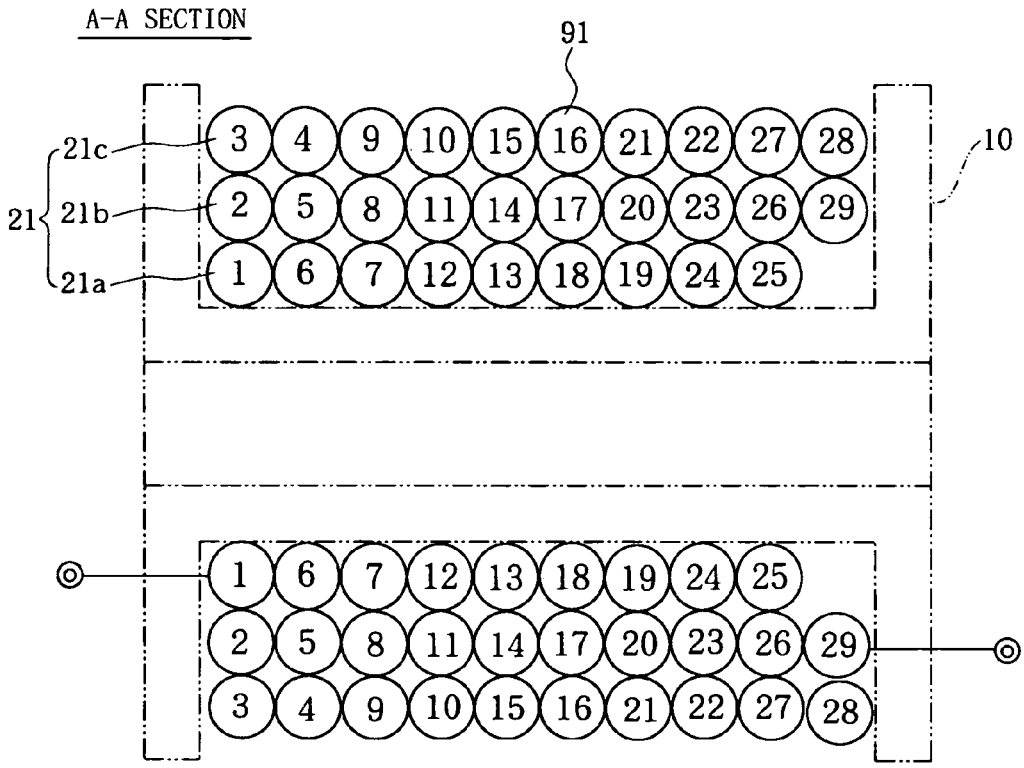
FIG. 2 is a sectional view of the air-core coil.

FIGS. 1 and 2 show the construction of an air-core coil 21 embodying the invention. The air-core coil 21 comprises a conductor 91 fitted around an outer surface of a bobbin 10, and has a layer-structure comprising a first layer 21*a*, second layer 21*b* and third layer 21*c* according to an example illustrated.

The air-core coil 21 is provided by winding one conductor therearound in the order indicated by the numerals 1 to 29 shown in FIG. 2. Unit coil portions are each provided by turns of consecutive numerals (1 to 3), (4 to 6), . . . , (25 to 27) and (28 to 29). The unit coil portions are arranged into ten rows axially of the coil.

Each of the unit coil portions comprises a unit turn portion having the greatest inner peripheral length, a unit turn portion having the medium inner peripheral length, and a unit turn portion having the smallest inner peripheral length, each of which has one turn of a conductor. The unit coil portions of the medium inner peripheral length are forced inwardly of the unit coil portions of the greatest inner peripheral length. The unit coil portions of the smallest inner peripheral length are further forced inwardly of the unit coil portions of the medium inner peripheral length. With the unit coil portion provided by turns of winding numbers 1 to 3, for example, the unit turn portion of winding number 2 is forced inwardly of the unit turn portion of winding number 3, and the unit turn portion of winding number 1 is forced inwardly of the unit turn portion of winding number 2.

Accordingly, the air-core coil 21 shown in FIG. 2 has alternately arranged axially of the coil, unit coil portions each comprising three unit turn portions wound sequentially from the inner peripheral side to the outer peripheral side, and unit coil portions each comprising three unit turn portions wound sequentially from the outer peripheral side to the inner peripheral side. The unit turn portion on the outermost periphery or on the innermost periphery of each of the unit coil portions is connected to the unit turn portion on the outermost periphery or on the innermost periphery of the adjacent unit coil portion.

Figure 3:
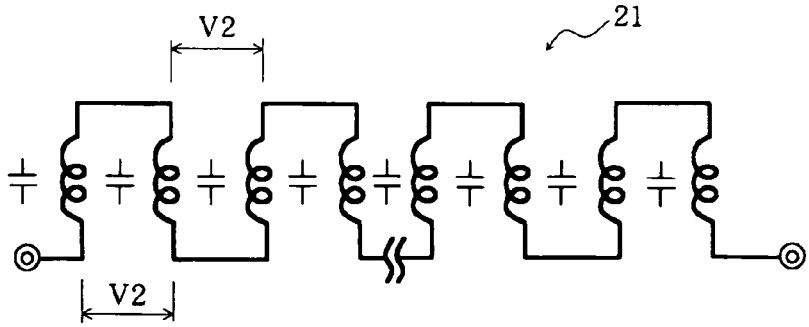
FIG. 3 is an equivalent circuit diagram of the air-core coil.

With the air-core coil 21 of the present invention, the conductor 91 is wound as layered in a direction orthogonal to an axis of the coil to form the unit coil portion while the unit coil portion is repeatedly formed axially of the coil, so that each pair of the turns adjacent to each other has a close winding number. For example, the unit turn portion of the number 4 and the unit turn portion of the number 9 are adjacent to each other, and the difference in the number between the two unit turn portions is only five. Accordingly, as shown in FIG. 3, a stray capacity rarely appears between each pair of turns adjacent to each other in a direction orthogonal to an axis of the coil. A stray capacity between each pair of turns adjacent to each other axially of the coil is extremely small. Consequently a potential difference V2 (voltage across the layers) between each pair of turns adjacent to each other becomes sufficiently low, improving a voltage resistance of the air-core coil 21. Furthermore the small stray capacity improves frequency characteristics of the air-core coil 21.

Figure 11:
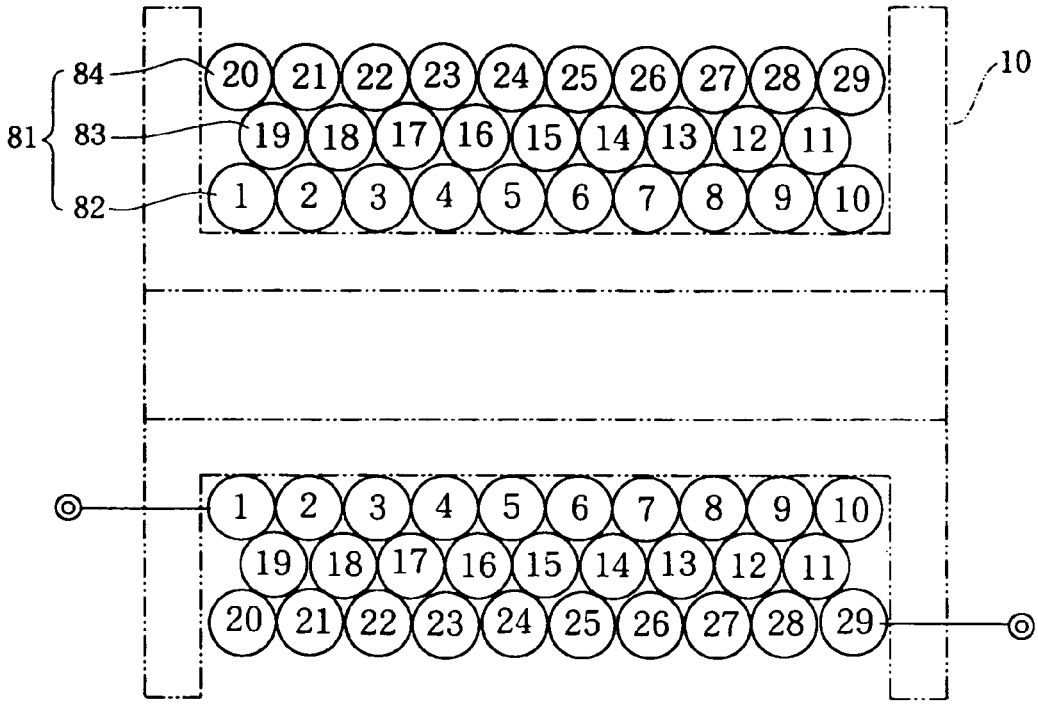
FIG. 11 PRIOR ART
FIG. 11 is a sectional view of the conventional air-core coil.
Figure 12:
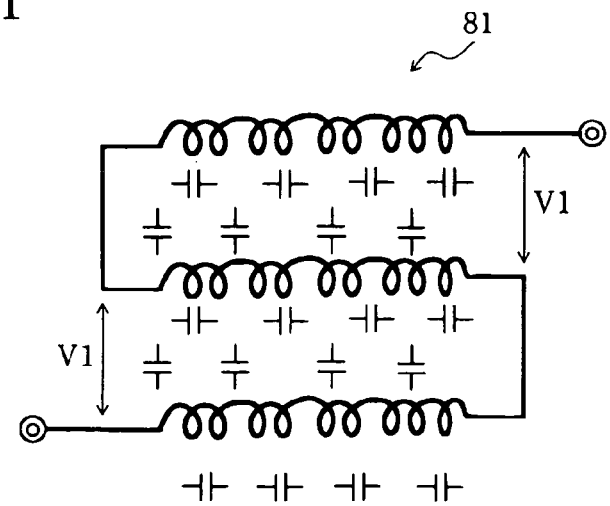
FIG. 12 PRIOR ART
FIG. 12 is an equivalent circuit diagram of the air-core coil.
Figure 13A:
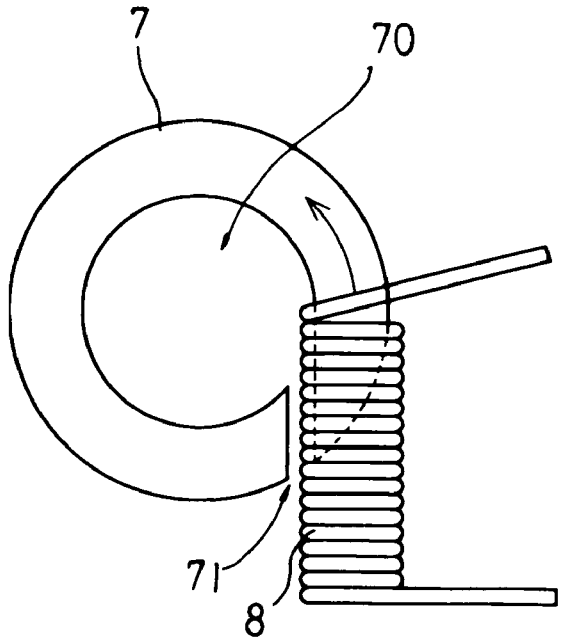
FIG. 13(a) PRIOR ART
FIGS. 13(*a*) and 13(*b*) include diagrams showing a step included in a conventional process for fabricating a choke coil.
Figure 13B:
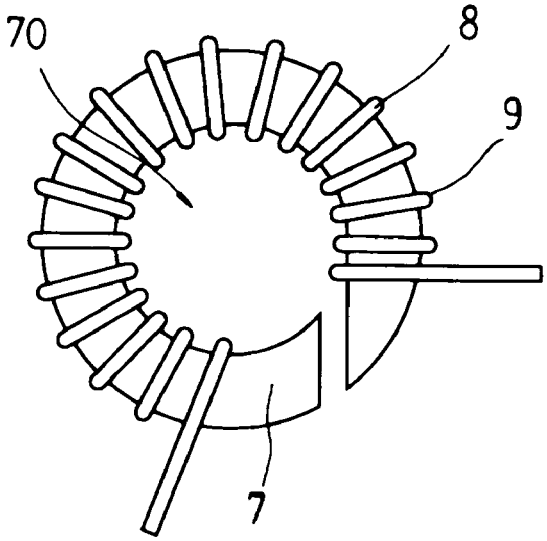
FIG. 13(b) PRIOR ART
Figure 14A:
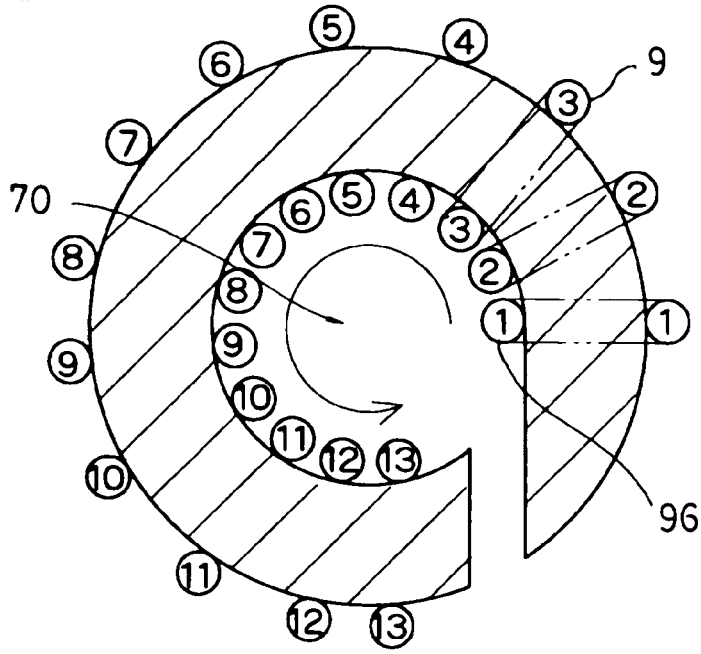
FIG. 14(a) PRIOR ART
FIGS. 14(*a*) and 14(*b*) include diagrams showing steps included in another conventional process for fabricating a choke coil.
Figure 14B:
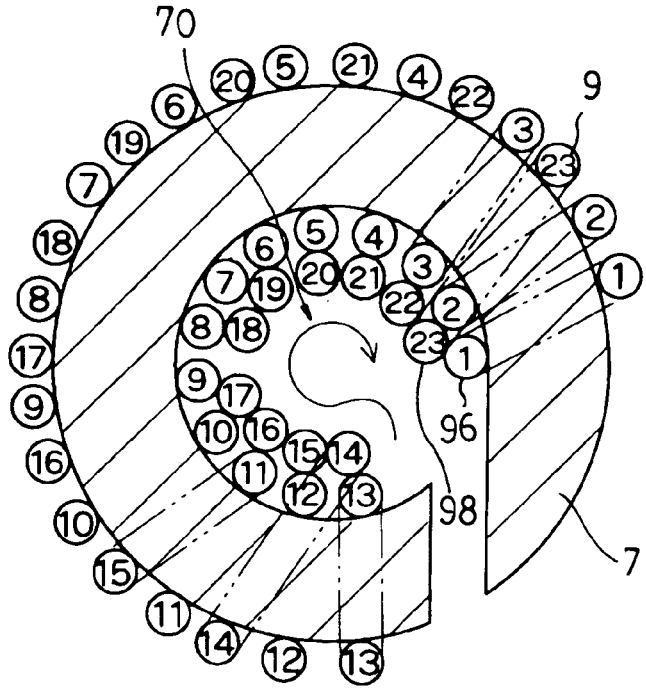
FIG. 14(b) PRIOR ART

For example, when the voltage across terminals of the coil is 200 V and the number of turns is 29 turns, the voltage per turn is approximately 6.9 V. With the conventional air-core coil 81 shown in FIG. 11, the voltage V1 across the unit turn portion of the winding number 1 and the unit turn portion of the winding number 19 is 6.9 V×18=124.2 V. On the other hand, with the air-core coil 21 of the present invention shown in FIG. 2, the voltage V2 across the unit turn portion of the winding number 1 and the unit turn portion of the winding number 6 is 6.9 V×5=34.5 V which is one-third of the conventional value. The voltage resistance of the coils matters particularly when an abnormal voltage is applied thereon, so that the air-core coil 21 of the present invention is made highly reliable.

Figure 4:
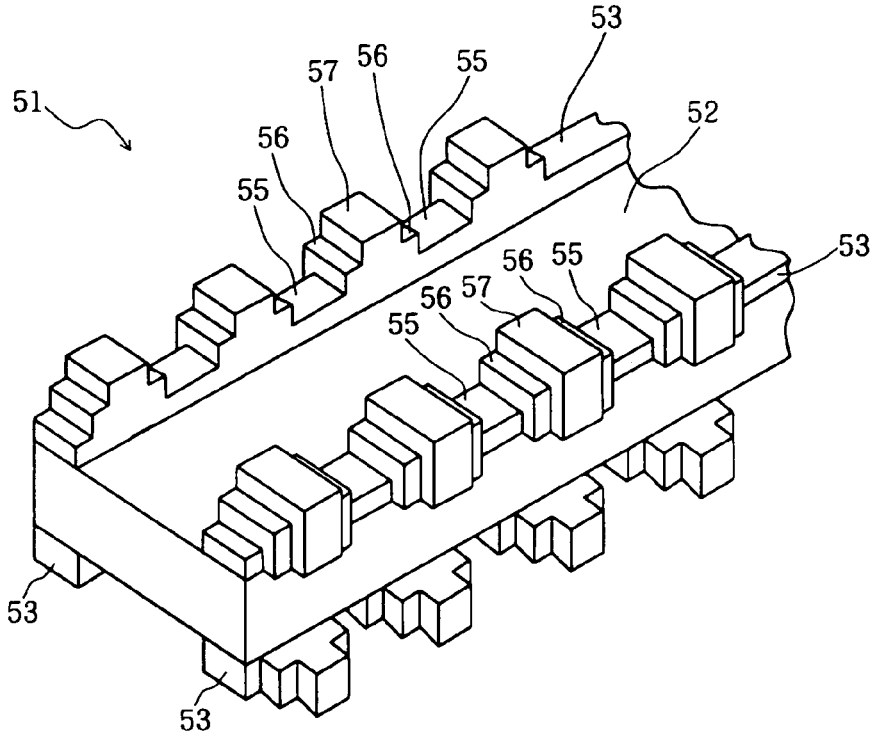
FIG. 4 is a perspective view of a wire wiring jig.
Figure 5:
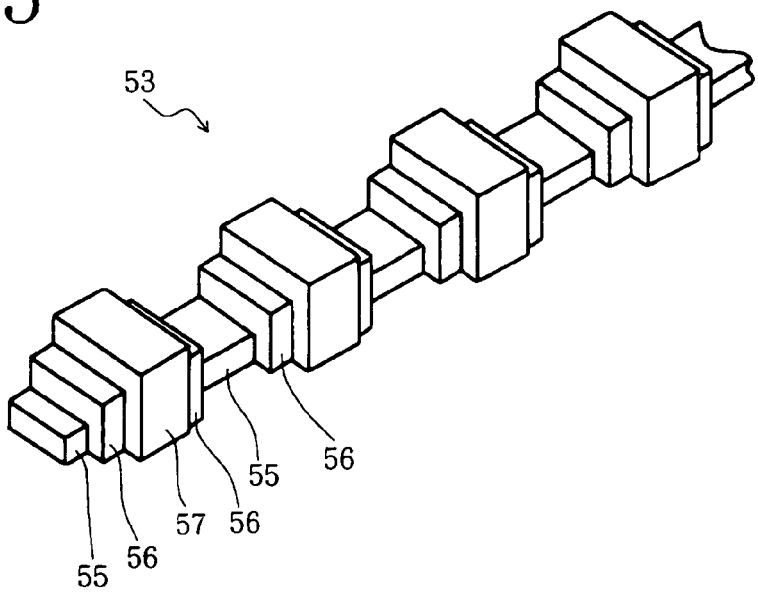
FIG. 5 is a perspective view of a stepped member.
Figure 6A:
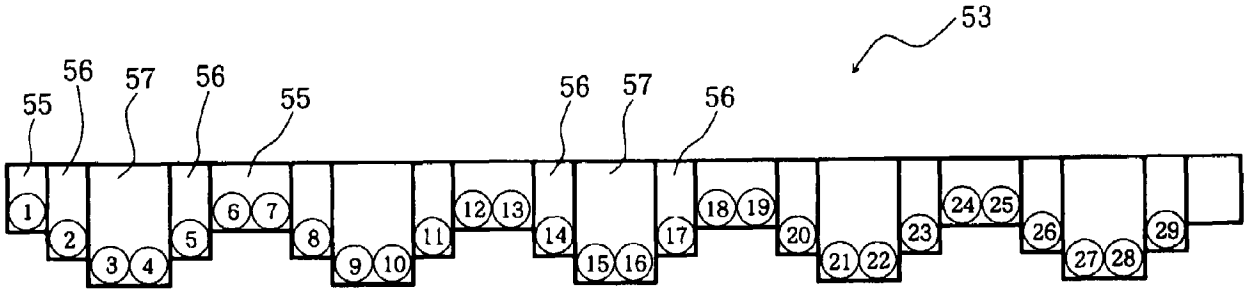
FIG. 6(*a*) is a plan view of the stepped member.
Figure 6B:
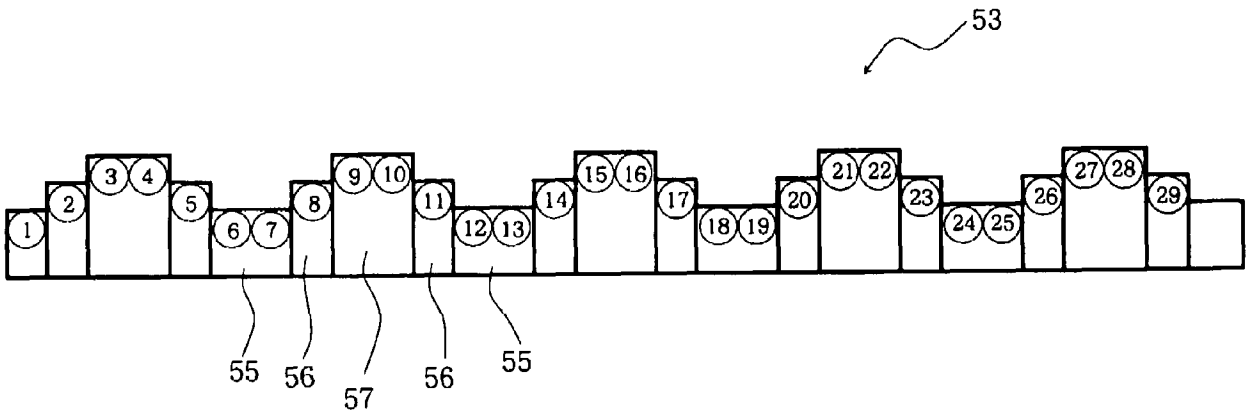

FIG. 4 shows a wire winding jig 51 for use in fabricating the air-core coil 81 of the present invention. The wire winding jig 51 comprises a flat plate member 52 and stepped members 53 removably fixed to opposite end portions of opposite surfaces of the flat plate member 52, respectively. As shown in FIG. 5, FIGS. 6(*a*) and 6(*b*), the stepped members 53 are formed by repeating an arrangement cycle comprising a low-level stepped portion 55, medium-level stepped portion 56, high-level stepped portion 57, medium-level stepped portion 56, and low-level stepped portion 55. Incidentally FIG. 6(*a*) is a plan view of the stepped member 53. FIG. 6(*b*) is a side elevation of the stepped member 53. Each stepped portion of the stepped members 53 is given the numerals 1 to 29 indicating the order when the conductor is wound.

Figure 7B:
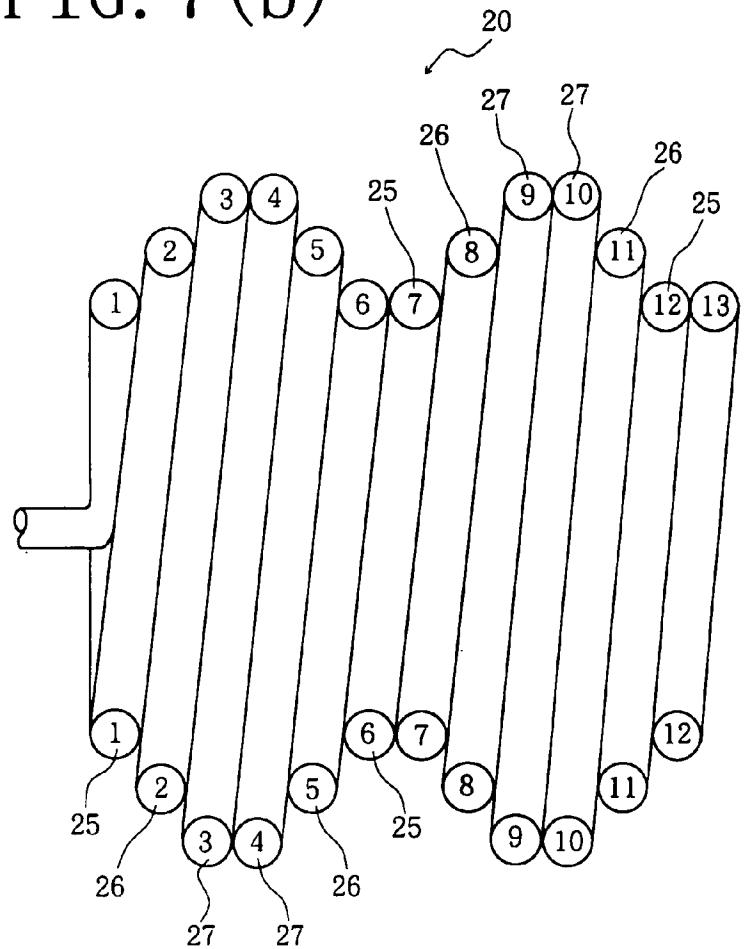
FIG. 7(*a*) is a perspective view of a partly finished coil.
Figure 7A:
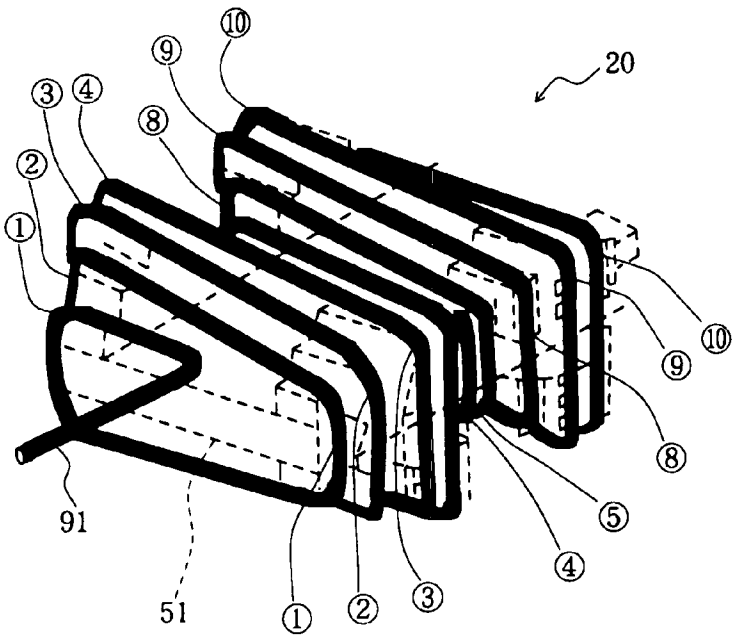
Figure 8B:
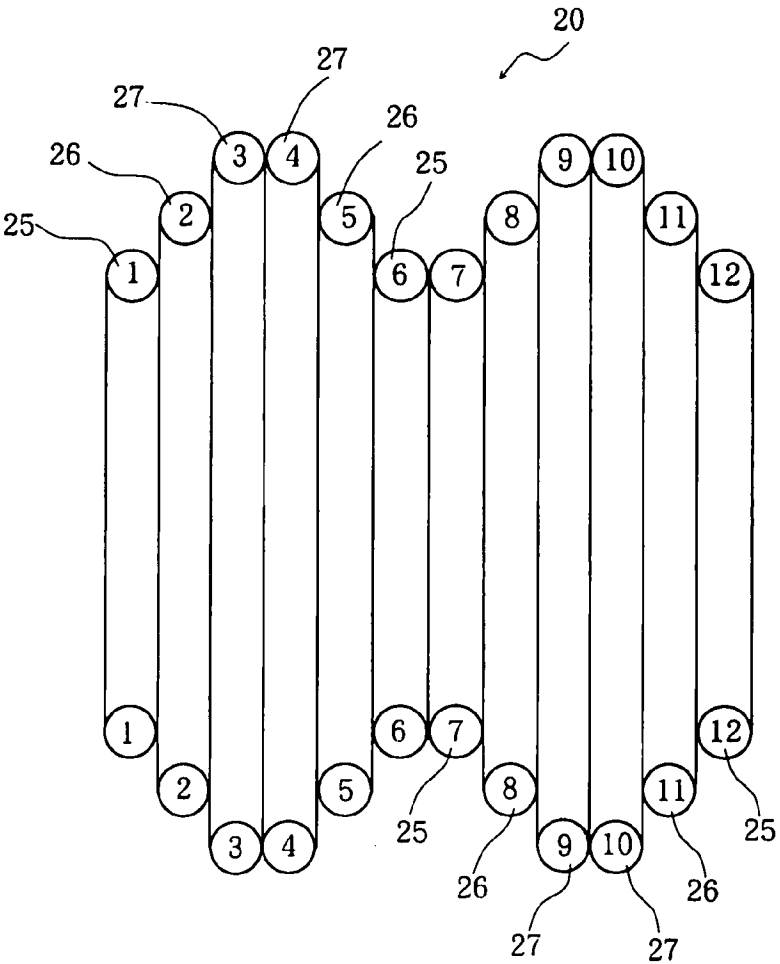
FIG. 8(*a*) is a perspective view of the partly finished coil as viewed from a direction different from FIG. 7(*a*)
Figure 8A:
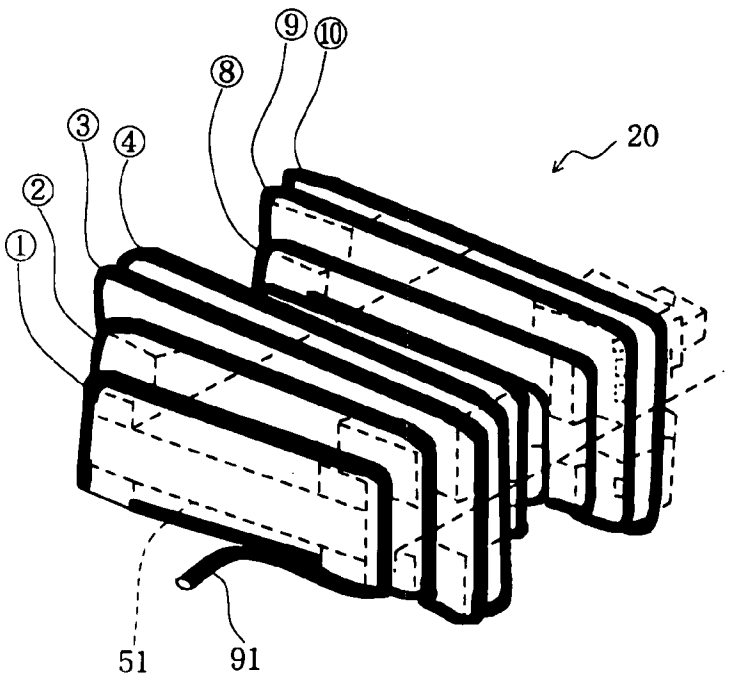

FIGS. 7(*a*) and 7(*b*), and FIGS. 8(*a*) and 8(*b*) are views of a partly finished coil 20 comprising a conductor 91 wound around the wire winding jig 51 and as viewed from a 180 degree-different direction.

Winding the conductor 91 starts with the low-level stepped portion 55 positioned on the end portion of the wire wiring jig 51 shown in FIG. 4, and proceeds sequentially to the medium level stepped portion 56, the high level stepped portion 57, the medium level stepped portion 56, and then the low level stepped portion 55. Incidentally whereas the low level stepped portion 55 and the medium level stepped portion 56 each has a width for winding the conductor 91 only one turn, the high level stepped portion 57 has a width for winding the conductor 91 two turns.

A first unit turn portion 25 having the smallest inner peripheral length is formed by winding the conductor 91 around the low level stepped portion 55. A second unit turn portion 26 having the medium inner peripheral length is formed by winding the conductor 91 around the medium level stepped portion 56. A third unit turn portion 27 having the greatest inner peripheral length is formed by winding the conductor 91 around the high level stepped portion 57. In these steps, as shown in FIGS. 7(*a*) and 7(*b*), when wiring the conductor proceeds from one stepped portion to the adjacent stepped portion of the wire winding jig 51, the conductor 91 moves therebetween as stretched in an oblique direction on one side surface of the wire wiring jig 51. Incidentally, as shown in FIGS. 8(*a*) and 8(*b*), the conductor 91 is straightened between the same level stepped portions on the other side surface of the wire wiring jig 51.

After the conductor 91 has been wound around the wire wiring jig 51 the required number of turns, the wire wiring jig 51 is disassembled to thereby obtain a partly finished coil 20 shown in FIG. 7(*a*) and FIG. 8(*a*). The partly finished coil 20 is thereafter compressed axially of the coil, as shown in FIG. 9(*a*) and FIG. 10(*a*), to thereby force the second unit turn portion 26 inwardly of the third unit turn portion 27, and to force the first unit turn portion 25 inwardly of the second unit turn portion 26, as shown in FIG. 9(*b*) and FIG. 10(*b*), whereby the air-core coil 21 having three layers can be obtained.

Figure 9A:
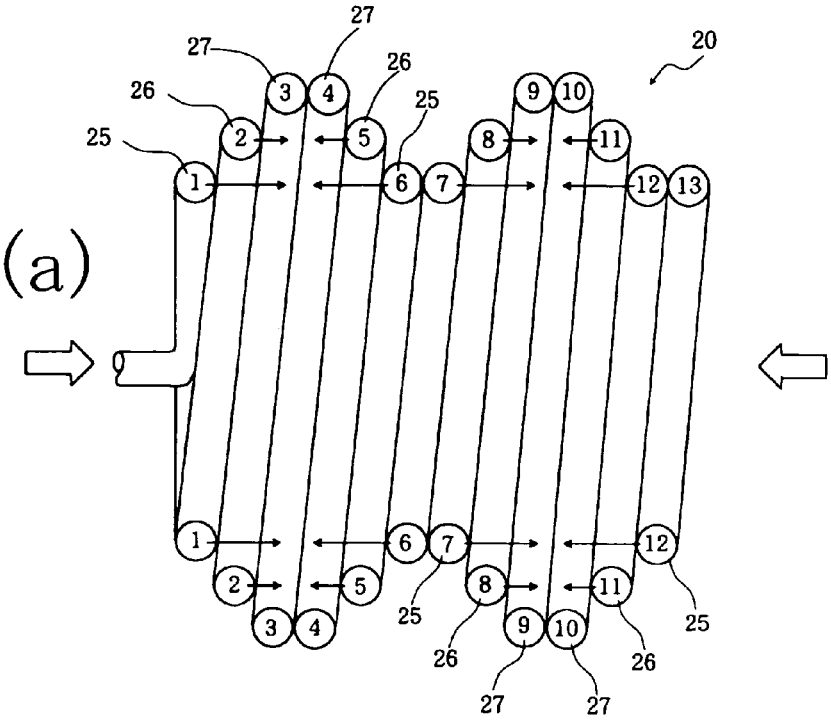
FIGS. 9(*a*) and 9(*b*) are sectional views illustrating a compressing step of the partly finished coil.
Figure 9B:
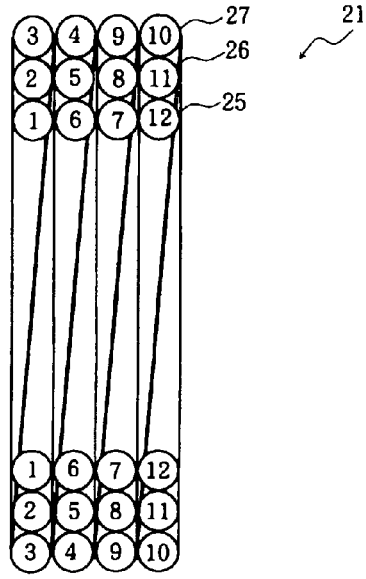
Figure 10A:
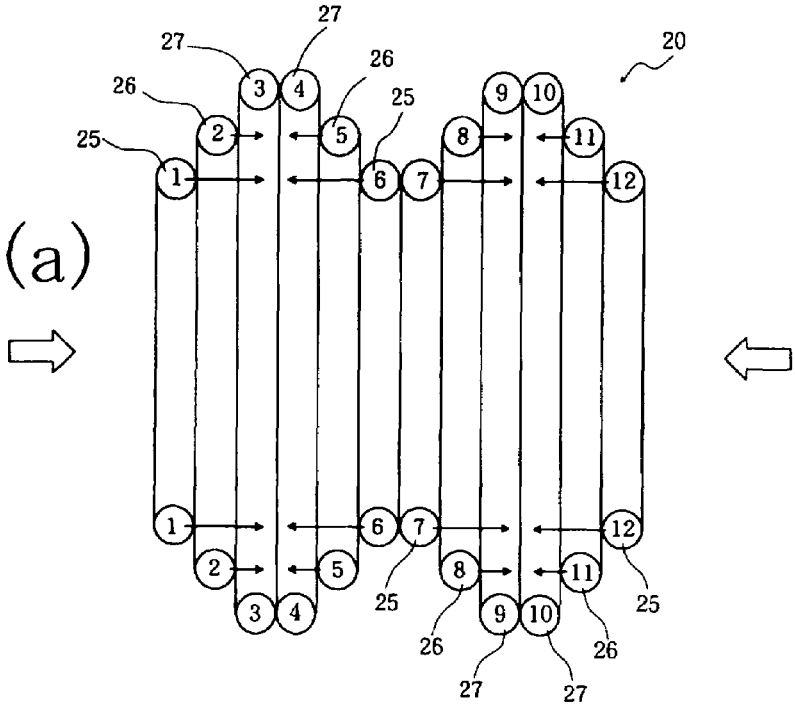
FIGS. 10(*a*) and 10(*b*) are sectional views illustrating a compressing step of the partly finished coil as seen from a direction different from FIGS. 9(*a*) and 9(*b*)
Figure 10B:
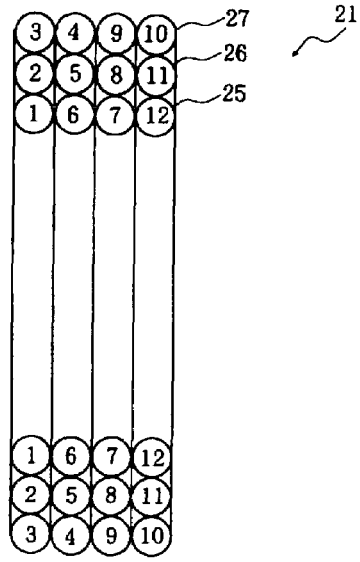

The air-core coil 21 having three layers shown in FIG. 9(*b*) and FIG. 10(*b*) involves an elastic repulsive force for stretching axially of the coil. The elastic repulsive force of the air-core coil 21 is, however, received by the bobbin 10 with the air-core coil 21 fitted around the bobbin 10 as shown in FIG. 1, maintaining the three-layer coil structure. Alternatively, the three-layer coil structure can also be maintained by wrapping with tape the air-core coil 21 having three layers and shown in FIG. 9(*b*) and FIG. 10(*b*).

According to the air-core coil 21 fabricating process as described, the air-core coil 21 of the present invention can be fabricated merely by making the partly finished coil 20 shown in FIG. 9(*a*) and FIG. 10(*a*) with the wire wiring jig 51 shown in FIG. 4, FIG. 5, FIG. 6(*a*), and FIG. 6(*b*), and thereafter compressing the partly finished coil 20 axially of the coil, as shown in FIG. 9(*b*) and FIG. 10(*b*). Thus the fabrication process can be automated with ease, and further the air-core coil 21 without losing its coil shape and as wound neatly in order can be obtained.

The device of the present invention is not limited to the foregoing embodiment in construction but can be modified variously within the technical scope set forth in the appended claims. For example, the structure of the air-core coil 21 is not limited to the three-layer structure, but the air-core coil 21 can be made into two-layer structure or four-or-more-layer structure. Furthermore, the wire wiring jig 51 shown in FIG. 4 is not limited in configuration to the one included in the above embodiment, but jigs of various shapes are usable insofar as air-core coils can be made wherein adjacent unit coil portions are different in inner peripheral length.

Furthermore, the conductor 91 forming the air-core coil 21 is not limited to a single wire like the conductor used in the foregoing embodiment but can be a plurality of wires. The conductor 91 is not further limited to the round conductor having a circular cross section, but can be a rectangular conductor having a rectangular cross section.

The invention claimed is:

1. An air-core coil comprising unit coil portions each having at least one conductor wound into a spiral form, the unit coil portions being arranged repeatedly axially of the coil, each of the unit coil portions comprising a plurality of unit turn portions which are different from each other in inner peripheral length and which are in direct contact with each other, the unit turn portions of small inner peripheral length being at least partly forced inwardly of the unit turn portions of great inner peripheral length, wherein the plurality of unit turn portions providing each of the unit coil portions are sequentially wound from an inner peripheral side to an outer peripheral side, or from the outer peripheral side to the inner peripheral side, one unit turn portion on an outermost periphery or on an innermost periphery being connected to another unit turn portion on an outermost periphery or on an innermost periphery, respectively, of the adjacent unit coil portion.

2. A coil device comprising an air-core coil fitted around a core or a bobbin, the air core coil wherein a plurality of unit turn portions which are different from each other in inner peripheral length and which are in direct contact with each other are consecutively formed axially of the coil, unit coil portions comprising the unit turn portions being repeatedly formed axially of the coil, by winding at least one conductor into a spiral form, to produce a partly finished air-core coil, and thereafter the partly finished coil is compressed axially of the coil to thereby force the unit turn portion of small inner peripheral length at least partly inwardly of the unit turn portion of great inner peripheral length from among the unit turn portions providing each of the unit coil portions, whereby each of the unit coil portions is made at least partly multi-layered.

3. An air-core coil wherein a plurality of unit turn portions which are different from each other in inner peripheral length are consecutively formed axially of the coil length and which are in direct contact with each other, unit coil portions comprising the unit turn portions being repeatedly formed axially of the coil, by winding at least one conductor into a spiral form, to produce a partly finished air-core coil, and thereafter the partly finished coil is compressed axially of the coil to thereby force the unit turn portion of small inner peripheral length at least partly inwardly of the unit turn portion of great inner peripheral length from among the unit turn portions providing each of the unit coil portions, whereby each of the unit coil portions is made at least partly multi-layered.

4. A coil device comprising an air-core coil fitted around a core or a bobbin, the air core coil comprising unit coil portions each having at least one conductor wound into a spiral form, the unit coil portions being arranged repeatedly axially of the coil, each of the unit coil portions comprising a plurality of unit turn portions which are different from each other in inner peripheral length and which are in direct contact with each other, and the unit turn portions of small inner peripheral length being at least partly forced inwardly of the unit turn portions of great inner peripheral length, wherein the air-core coil includes the plurality of unit turn portions providing each of the unit coil portions, the unit turn portions being sequentially wound from an inner peripheral side to an outer peripheral side, or from the outer peripheral side to the inner peripheral side, one unit turn portion on an outermost periphery or on an innermost periphery being connected to another unit turn portion on an outermost periphery or on an innermost periphery, respectively of the adjacent unit coil portion.

5. A process for fabricating an air-core coil comprising winding at least one conductor into a spiral form to thereby form, axially of the coil, consecutively a plurality of unit turn portions which are different from each other in inner peripheral length and which are in direct contact with each other to repeatedly form, axially of the coil, unit coil portions comprising the unit turn portions to thereby produce a partly finished air-core coil, and compressing, axially of the coil, the partly finished coil to thereby force the unit turn portions of small inner peripheral length at least partly inwardly of the unit turn portions of great inner peripheral length from among the unit turn portions providing each of the unit coil portions, thereby making each of the unit coil portions at least partly multi-layered, wherein the partly finished coil is fabricated by winding the conductor around an outer peripheral surface of a wire wiring jig, the wire wiring jig comprising a plurality of winding cores arranged axially of the coil, each pair of the adjacent winding cores being different from each other in outer peripheral length, the unit turn portion of small inner peripheral length being formed by winding the conductor around the wiring core of small outer peripheral length of the jig, the unit turn portion of great inner peripheral length being formed by winding the conductor around the wiring core of great outer peripheral length of the jig.

* * * * *